US010903024B1

(12) United States Patent
Liu et al.

(10) Patent No.: US 10,903,024 B1
(45) Date of Patent: Jan. 26, 2021

(54) KEYBOARD DEVICE

(71) Applicant: Primax Electronics Ltd., Taipei (TW)

(72) Inventors: Chun-Yuan Liu, Taipei (TW); Tsu-Yi Chen, Taipei (TW); Lei-Lung Tsai, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/833,888

(22) Filed: Mar. 30, 2020

(30) Foreign Application Priority Data

Dec. 23, 2019 (CN) ..... 2019 1 1337008

(51) Int. Cl.
*H01H 13/703* (2006.01)
*H01H 13/7065* (2006.01)

(52) U.S. Cl.
CPC ..... *H01H 13/7065* (2013.01); *H01H 13/703* (2013.01); *H01H 2227/036* (2013.01); *H01H 2233/03* (2013.01)

(58) Field of Classification Search
CPC ..... H01H 3/125; H01H 13/83; H01H 13/705; H01H 13/14; H01H 13/70; H01H 2221/062; H01H 2221/026; H01H 9/26; H01H 13/72; H01H 25/00; H01H 25/04; H01H 1/02
See application file for complete search history.

(56) References Cited

U.S. PATENT DOCUMENTS 5,463,195 A * 10/1995 Watanabe ..... H01H 3/125 200/344
7,994,446 B2 * 8/2011 Chao ..... H01H 3/125 200/344
9,959,990 B1 * 5/2018 Pan ..... H01H 13/70
9,959,992 B1 * 5/2018 Chen ..... H01H 13/705
2020/0328049 A1 * 10/2020 Chen ..... H05K 1/144

* cited by examiner

*Primary Examiner* — Ahmed M Saeed
(74) *Attorney, Agent, or Firm* — Kirton McConkie; Evan R. Witt

(57) ABSTRACT

A keyboard device includes a membrane circuit board, a base plate, a coupling structure and a key structure. The base plate includes a substrate and a protrusion structure. The protrusion structure is bent and protruded upwardly from the substrate. A bent region is formed between the protrusion structure and the substrate. A coupling opening is formed in the bent region. The coupling structure filled in the coupling opening to cover the protrusion structure. The key structure includes a keycap and a connecting element. The connecting element is connected between the keycap and the coupling structure.

10 Claims, 12 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2, 3 and 4. FIG. 1 is a schematic perspective view illustrating the outer appearance of a conventional keyboard device. FIG. 2 is a schematic exploded view illustrating a portion of the keyboard device as shown in FIG. 1 and taken along a viewpoint. FIG. 3 is a schematic exploded view illustrating a portion of the keyboard device as shown in FIG. 1 and taken along another viewpoint. FIG. 4 is a schematic cross-sectional view illustrating a portion of the keyboard device as shown in FIG. 1. For succinctness, only one key structure and the related components are shown in FIGS. 1, 2, 3 and 4. In practice, the keyboard device comprises one or more than one key structure.

The conventional keyboard device 1 comprises plural key structures 10, a base plate 11 and a membrane circuit board 12. The membrane circuit board 12 is arranged between the key structures 10 and the base plate 11. Each key structure 10 comprises a keycap 101, a connecting element 102 and an elastic element 103. The connecting element 102 is connected between the keycap 101 and the base plate 11. Consequently, the keycap 101 is movable upwardly or downwardly relative to the base plate 11. The elastic element 103 is arranged between the keycap 101 and the base plate 11. Moreover, the elastic element 103 comprises a contacting part 1031. For example, the connecting element 102 is a scissors-type connecting element. Moreover, the connecting element 102 comprises a first frame 1021 and a second frame 1022. The second frame 1022 is pivotally coupled to the first frame 1021. Each keycap 101 comprises a locking part 1011 and a hooking part 1012.

The base plate 11 comprises a substrate 113, a first hook 111 and a second hook 112. The first hook 111 and the second hook 112 are bent and protruded upwardly from the substrate 113 and penetrated through the corresponding circuit board openings 125 of the membrane circuit board 12. A first end of the first frame 1021 is connected with the hooking part 1012 of the keycap 101. A second end of the first frame 1021 is connected with the second hook 112 of the base plate 11. A first end of the second frame 1022 is connected with the locking part 1011 of the keycap 101. A second end of the second frame 1022 is connected with the first hook 111 of the base plate 11. Due to the above design, the first frame 1021 and the second frame 1022 can be swung relative to each other. That is, the first frame 1021 and the second frame 1022 are selectively switched from a stacked state to an open-scissors state or switched from the open-scissors state to the stacked state.

The membrane circuit board 12 comprises plural membrane switches 121. While the keycap 101 of any key structure 10 is depressed and moved downwardly relative to the base plate 11, the first frame 1021 and the second frame 1022 of the connecting element 102 are switched from the open-scissors state to the stacked state. As the keycap 101 is moved downwardly to compress the elastic element 103, the corresponding membrane switch 121 is contacted and pushed by the contacting part 1031 of the elastic element 103. Consequently, the corresponding membrane switch 121 is triggered, and the keyboard device 1 generates a corresponding key signal.

When the keycap 101 of the key structure 10 is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

In the above keyboard device 1, the plural key structures 10 and the membrane circuit board 12 are supported on the base plate 11. For increasing the structural strength of the base plate 11, the base plate 11 is made of a metallic material. Nowadays, the trends of designing most electronic devices are toward miniaturization. Consequently, the substrate 113 of the base plate 11 becomes thinner and thinner. If the substrate 113 is too thin, the first hook 111 and the second hook 112 that are bent and protruded upwardly from the substrate 113 to be connected with the connecting element 102 of the key structure 10 are readily suffered from deformation. Especially when the connecting element 102 is assembled with the base plate 11 or one key structure 10 of the keyboard device 1 is impacted by a strong force, the deformation degrees of the first hook 111 and the second hook 112 are more obvious. Since the thickness reduction of the substrate 113 of the base plate 11 is limited, it is difficult to decrease the overall weight of the keyboard device 1 through the thickness reduction of the substrate 113.

In other words, the conventional keyboard device 1 needs to be further improved.

SUMMARY OF THE INVENTION

The present invention provides a keyboard device. A coupling structure of the keyboard device to be connected with a connecting element of a key structure are additionally formed on a base plate. The base plate is not directly connected with the connecting element. Consequently, the technologies of the present invention are helpful for the miniaturization of the keyboard device, and the overall weight of the keyboard device is reduced.

In accordance with an aspect of the present invention, a keyboard device is provided. The keyboard device includes a membrane circuit board, a base plate, a coupling structure and a key structure. The membrane circuit board includes a membrane switch. The base plate includes a substrate and a protrusion structure. The substrate is located under the membrane circuit board. The protrusion structure is bent and protruded upwardly from the substrate. A bent region is formed between the protrusion structure and the substrate. A coupling opening is formed in the bent region. The coupling opening is filled with and covered by the protrusion structure. The key structure includes a keycap and a connecting element. The keycap is located over the membrane switch and connected between the keycap and the coupling structure. The keycap is movable upwardly or downwardly relative to the membrane circuit board through the connecting element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
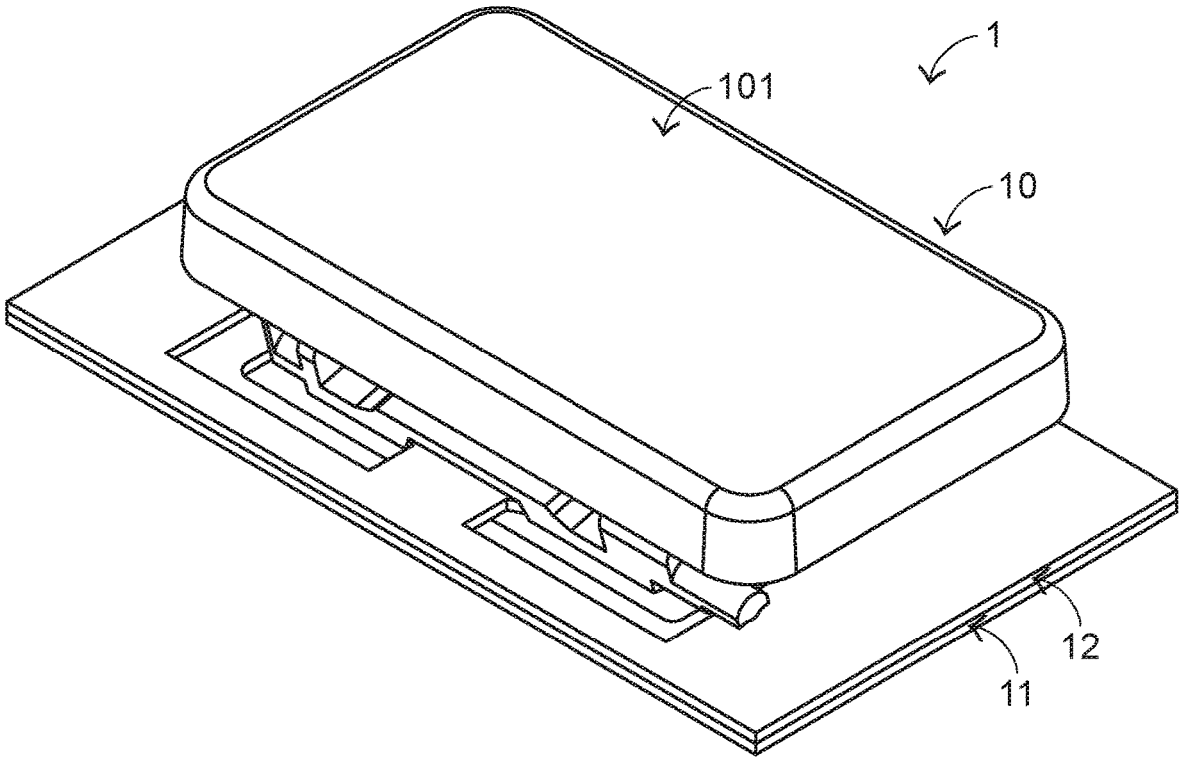
FIG. 1 PRIOR ART
FIG. 1 is a schematic perspective view illustrating the outer appearance of a conventional keyboard device.
Figure 2:
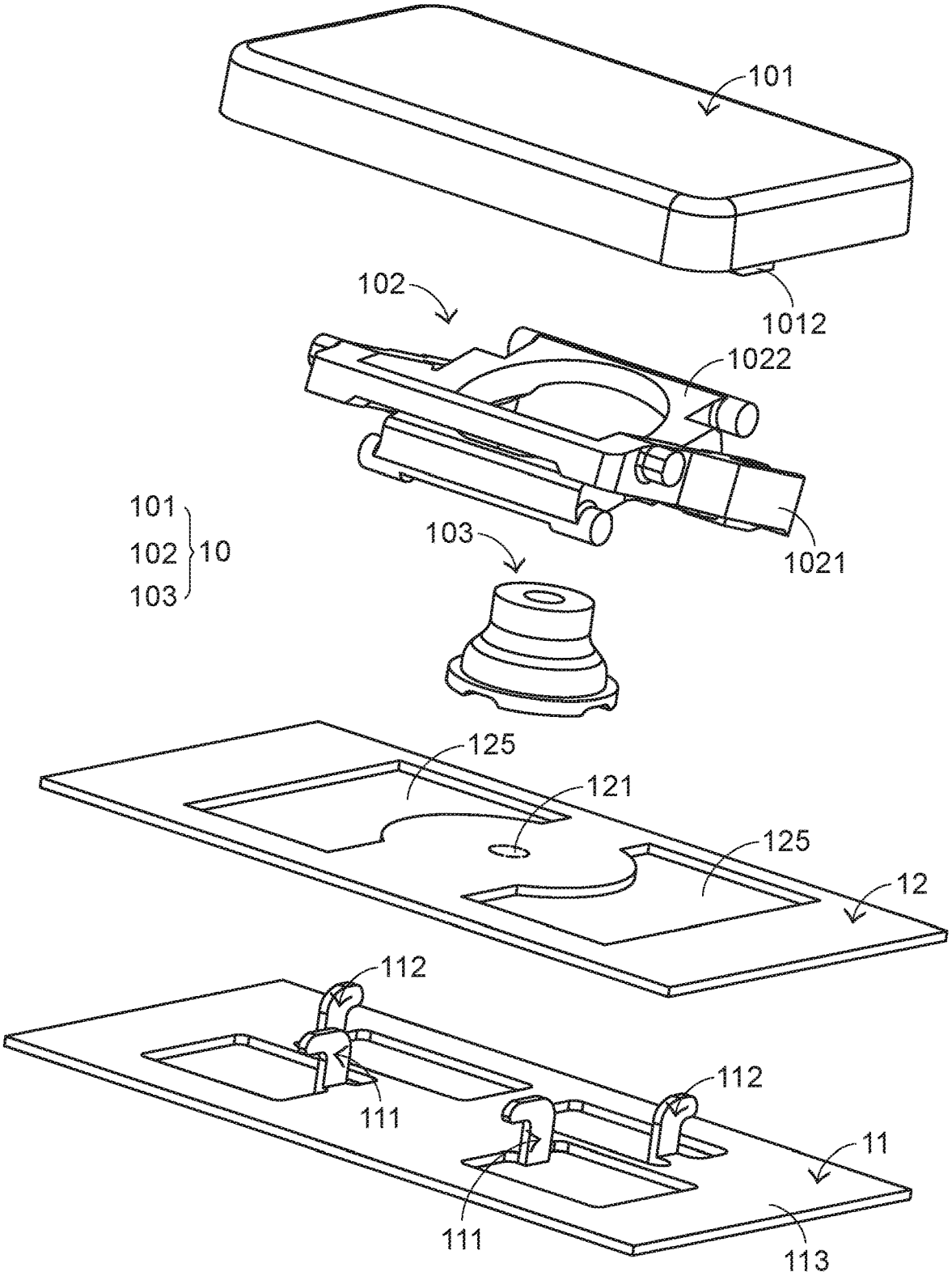
FIG.2 PRIOR ART
FIG. 2 is a schematic exploded view illustrating a portion of the keyboard device as shown in FIG. 1 and taken along a viewpoint.
Figure 3:
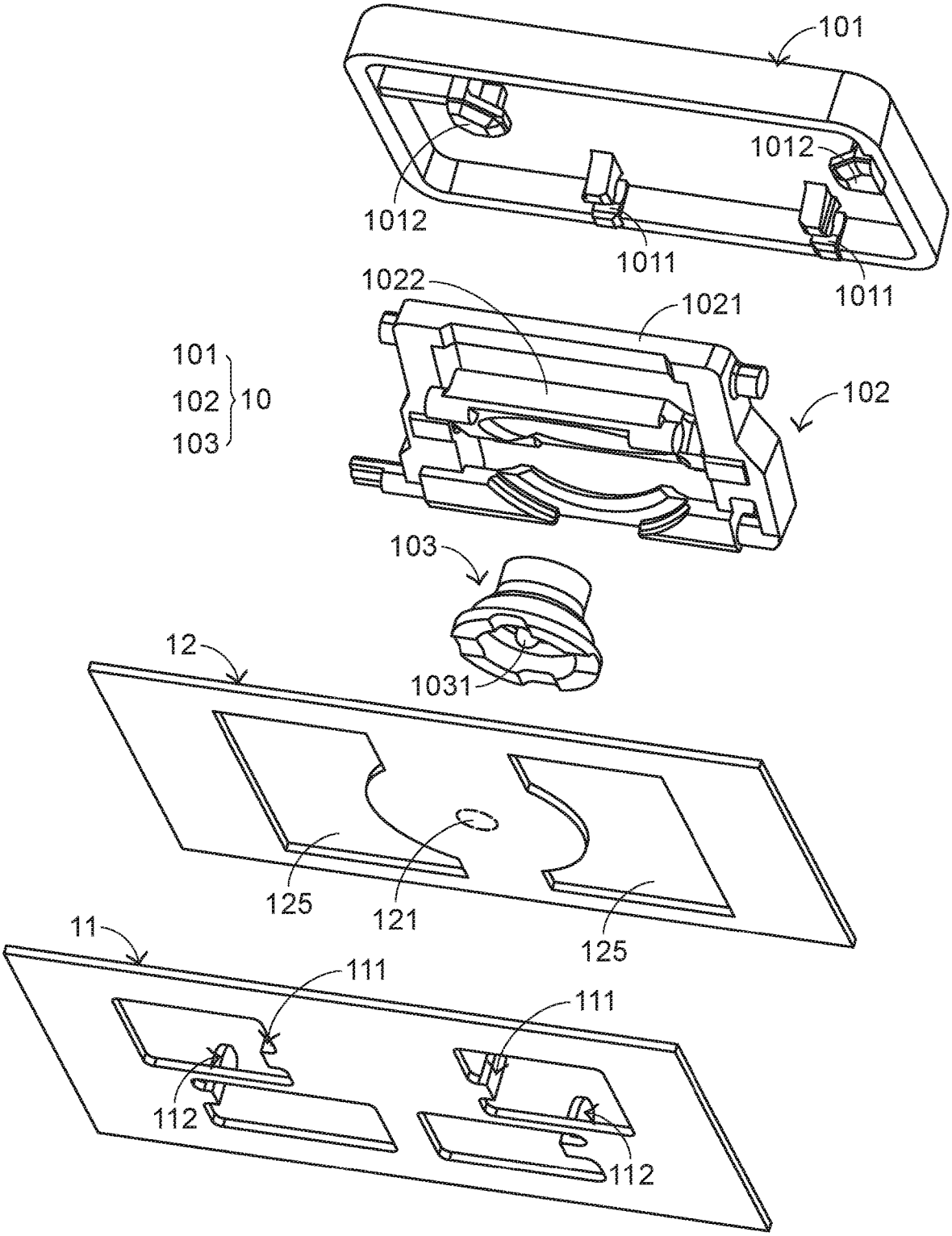
FIG.3 PRIOR ART
FIG. 3 is a schematic exploded view illustrating a portion of the keyboard device as shown in FIG. 1 and taken along another viewpoint.
Figure 4:
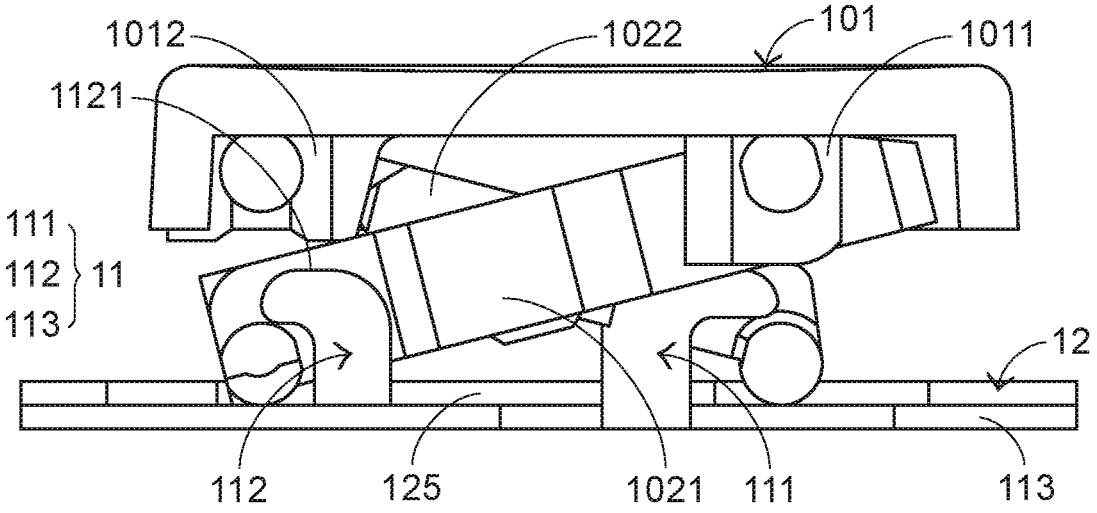
FIG.4 PRIOR ART
FIG. 4 is a schematic cross-sectional view illustrating a portion of the keyboard device as shown in FIG. 1.

The embodiments of present invention will be described more specifically with reference to the following drawings. Generally, in the drawings and specifications, identical or similar components are designated by identical numeral references. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 5:
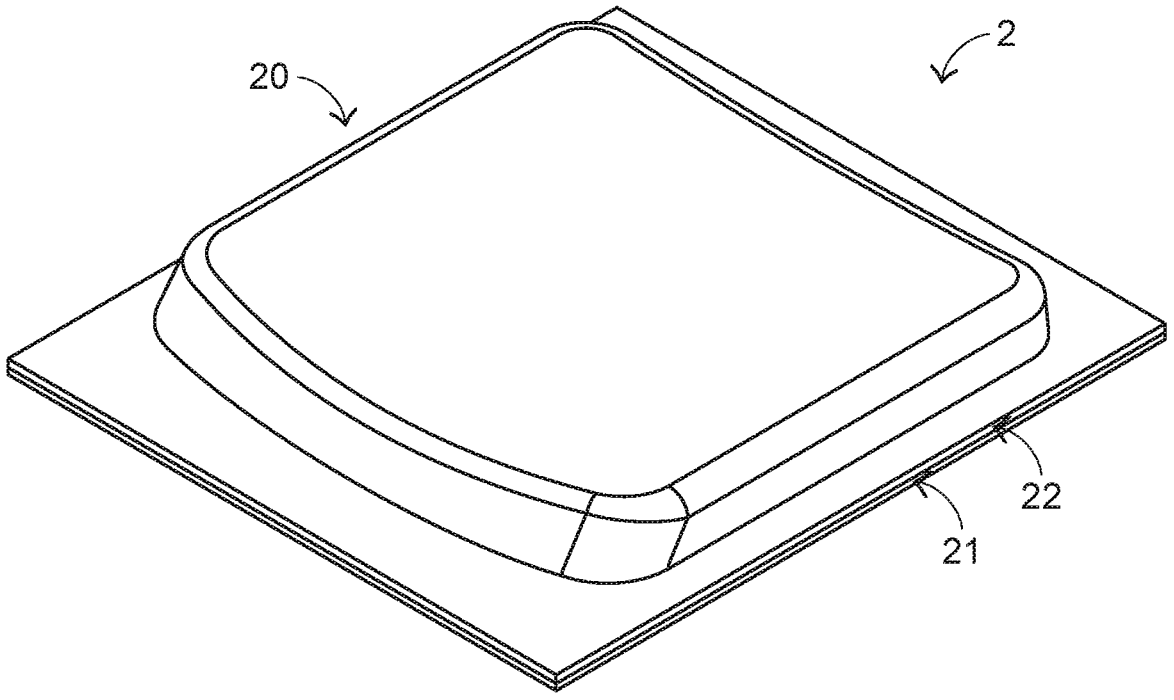
FIG. 5 is a schematic perspective view illustrating the outer appearance of a keyboard device according to a first embodiment of the present invention.
Figure 6:
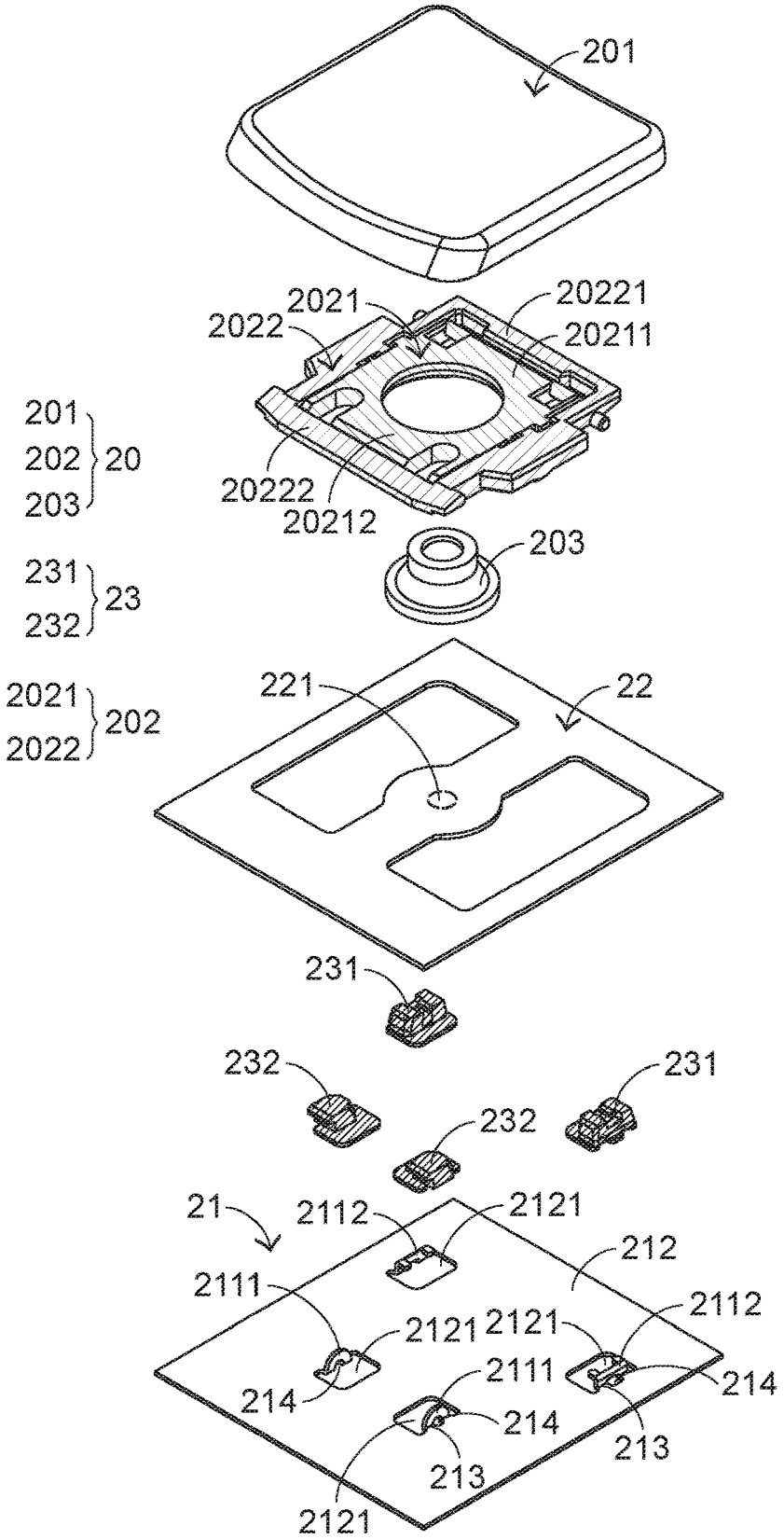
FIG. 6 is a schematic exploded view illustrating a portion of the keyboard device as shown in FIG. 5.
Figure 7:
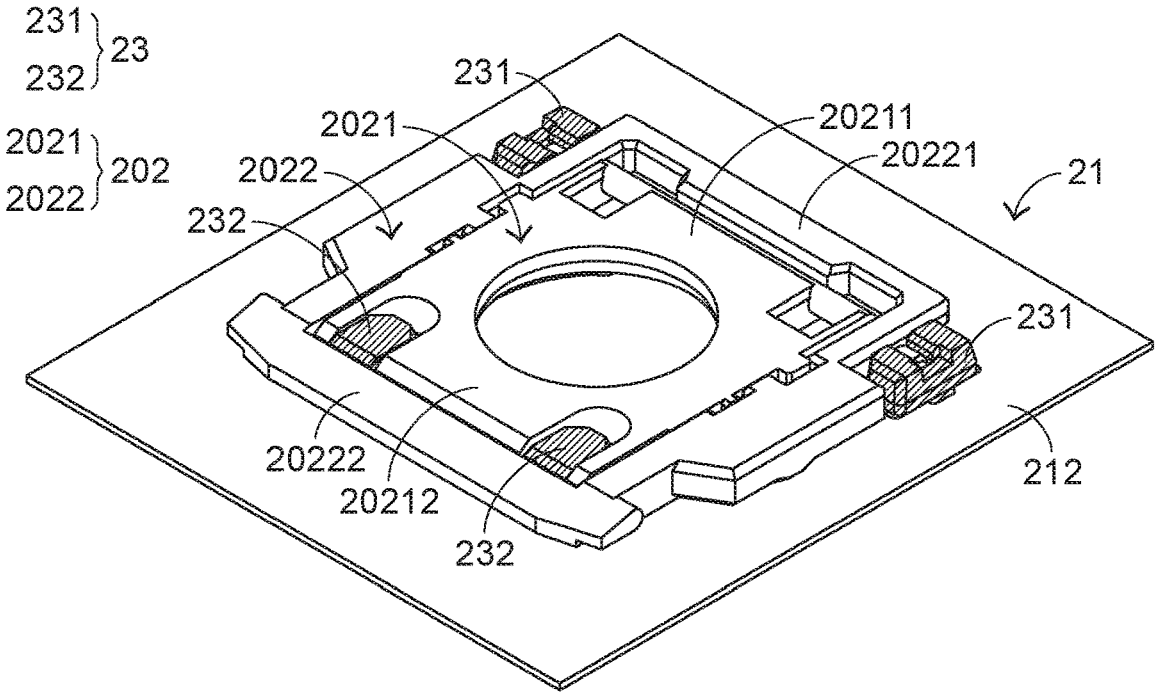
FIG. 7 is a schematic perspective view illustrating a portion of the keyboard device as shown in FIG. 5.
Figure 8:
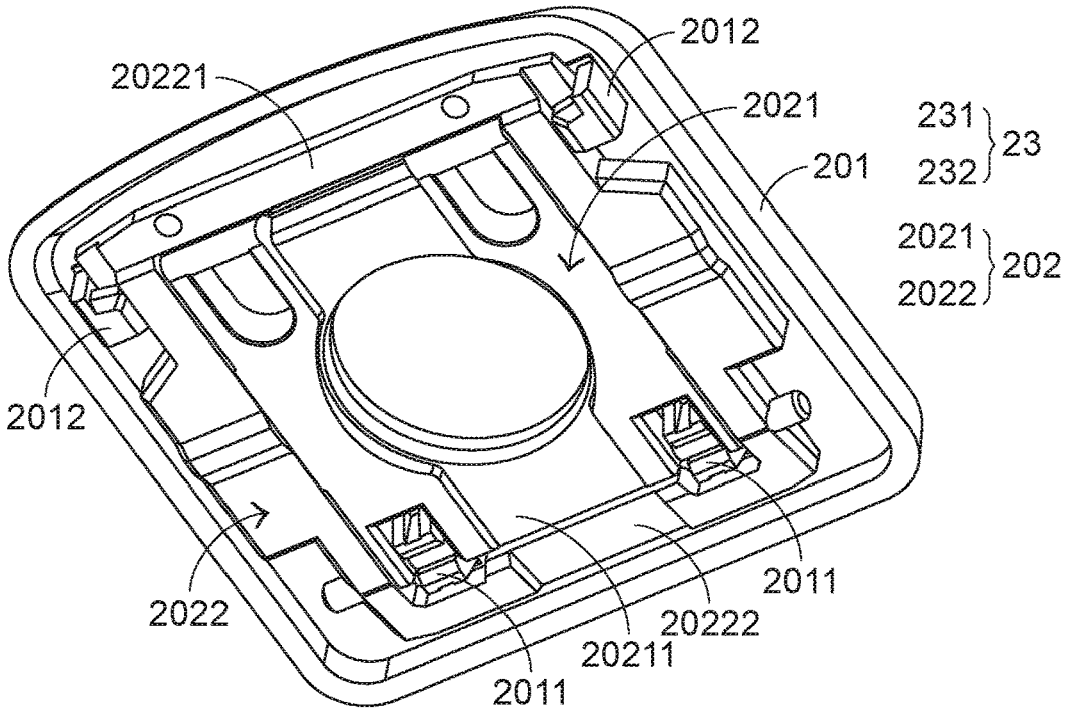
FIG. 8 is a schematic perspective view illustrating another portion of the keyboard device as shown in FIG. 5.

Please refer to FIGS. 5, 6, 7 and 8. FIG. 5 is a schematic perspective view illustrating the outer appearance of a keyboard device according to a first embodiment of the present invention. FIG. 6 is a schematic exploded view illustrating a portion of the keyboard device as shown in FIG. 5. FIG. 7 is a schematic perspective view illustrating a portion of the keyboard device as shown in FIG. 5. FIG. 8 is a schematic perspective view illustrating another portion of the keyboard device as shown in FIG. 5. In practice, the keyboard device comprises more than one key structure. For succinctness, only one key structure and the related components are shown in FIGS. 5, 6, 7 and 8 and some components are indicated by different textured patterns.

The keyboard device 2 comprises plural key structures 20, a base plate 21, a membrane circuit board 22 and plural coupling structures 23. These key structures 20 are classified into some types, e.g., ordinary keys, numeric keys and function keys. When one of the key structures 20 is depressed by the user's finger, a corresponding key signal is generated to a computer (not shown), and thus the computer executes a function corresponding to the depressed key structure. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

The base plate 21 comprises a substrate 212 and plural protrusion structures 211. The substrate 212 is located under the membrane circuit board 22. The plural protrusion structures 211 are bent and protruded upwardly from the substrate 212 and penetrated through the membrane circuit board 22. Preferably but not exclusively, the base plate 21 is made of a metallic material. The plural coupling structures 23 are aligned with the corresponding protrusion structures 211 and disposed on the base plate 21. The operations of the plural coupling structures 23 will be described later.

Each key structure 20 comprises a keycap 201, a connecting element 202 and an elastic element 203. The connecting element 202 is connected between the keycap 201 and the corresponding coupling structure 23. Consequently, the keycap 201 is movable upwardly or downwardly relative to the membrane circuit board 22. The elastic element 203 is arranged between the keycap 201 and the membrane circuit board 22. Moreover, the elastic element 203 comprises a contacting part (not shown).

Moreover, the keycap 201 comprises fixed hooks 2011 and movable hooks 2012. The fixed hooks 2011 and the movable hooks 2012 are disposed on the bottom surface of the keycap 201. The plural coupling structures 23 comprise fixed coupling structures 231 and movable coupling structures 232. In an embodiment, the connecting element 202 is a scissors-type connecting element. Moreover, the connecting element 202 comprises a first frame 2021 and a second frame 2022. The second frame 2022 is pivotally coupled to the first frame 2021. The first frame 2021 is an inner frame, and the second frame 2022 is an outer frame. The first end 20211 of the first frame 2021 is connected with the corresponding fixed hooks 2011 of the keycap 201. The second end 20212 of the first frame 2021 is connected with the corresponding movable coupling structures 232. The first end 20221 of the second frame 2022 is connected with the corresponding fixed coupling structures 231. The second end 20222 of the second frame 2022 is connected with the movable hooks 2012 of the keycap 201.

Due to the above structure, the first end 20211 of the first frame 2021 is pivotally coupled to the corresponding fixed hooks 2011 of the keycap 201, the second end 20212 of the first frame 2021 is slidable within the corresponding movable coupling structures 232, the first end 20221 of the second frame 2022 is pivotally coupled to the corresponding fixed coupling structures 231, and the second end 20222 of the second frame 2022 is slidable within the movable hooks 2012 of the keycap 201. Due to the above structure, the first frame 2021 and the second frame 2022 can be swung relative to each other. Consequently, the first frame 2021 and the second frame 2022 are switched from a stacked state to an open-scissors state or switched from the open-scissors state to the stacked state. The connecting relationships between the connecting element 202, the coupling structures 23 and the keycap 201 are presented herein for purpose of illustration and description only.

Figure 9:
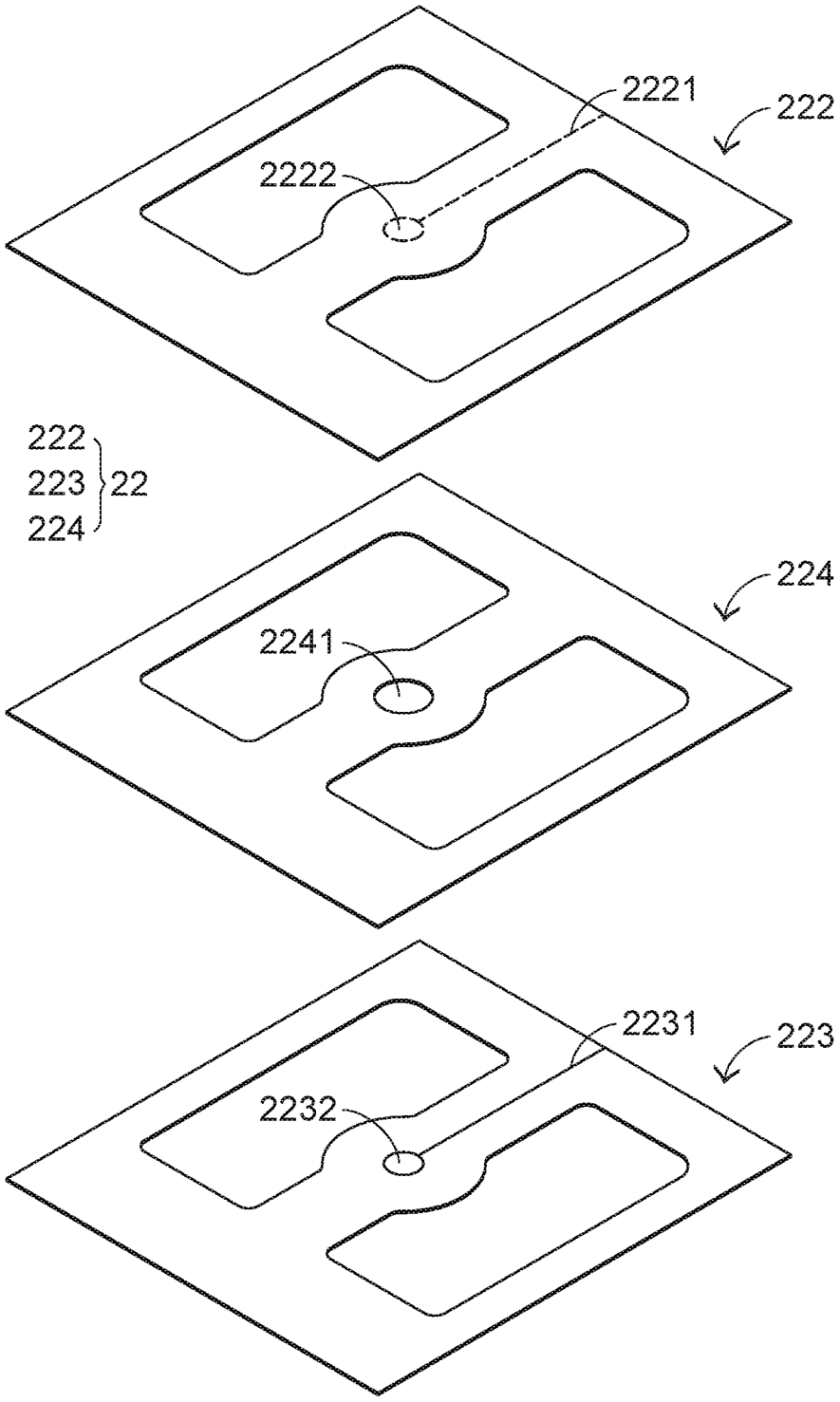
FIG. 9 is a schematic exploded view illustrating the membrane circuit board of the keyboard device as shown in FIG. 5.

FIG. 9 is a schematic exploded view illustrating the membrane circuit board of the keyboard device as shown in FIG. 5. The membrane circuit board 22 comprises plural film layers. The thickness of each film layer is presented herein for purpose of illustration and description only. For succinctness, only one upper contact, one lower contact and one perforation are shown in FIG. 9.

The membrane circuit board 22 comprises an upper film layer 222, a lower film layer 223 and an intermediate film layer 224, which are arranged in a stack form. A first circuit pattern 2221 is formed on a bottom surface of the upper film layer 222. The first circuit pattern 2221 comprises plural upper contacts 2222 corresponding to the plural key structures 20. A second circuit pattern 2231 is formed on a top surface of the lower film layer 223. The second circuit pattern 2231 comprises plural lower contacts 2232 corresponding to the plural upper contacts 2222. Each of the upper contacts 2222 and the corresponding lower contact 2232 are separated from each other by a spacing distance. Moreover, each of the upper contacts 2222 and the corresponding lower contact 2232 are collectively defined as a membrane switch 221. For maintaining the spacing distance between each upper contact 2222 and the corresponding lower contact 2232, the intermediate film layer 224 is arranged between the upper film layer 222 and the lower film layer 223. In addition, the intermediate film layer 224 comprises plural perforations 2241 corresponding to the plural upper contacts 2222 and the plural lower contacts 2232.

Preferably but not exclusively, each of the upper film layer 222, the lower film layer 223 and the intermediate film layer 224 is made of polycarbonate (PC), polyethylene terephthalate (PET), polymethylmethacrylate (PMMA), polyurethane (PU) or polyimide (PI).

The operations of the keyboard device of the present invention will be described as follows. While the keycap 201 of any key structure 20 is depressed and moved downwardly relative to the membrane circuit board 22, the first frame 2021 and the second frame 2022 of the connecting element 202 are switched from the open-scissors state to the stacked state. Moreover, as the keycap 201 is moved downwardly to compress the elastic element 203, the corresponding upper contact 2222 of the membrane circuit board 22 is pushed and triggered by the contacting part of the elastic element 203. Consequently, the corresponding upper contact 2222 is contacted with the corresponding lower contact 2232 through the corresponding perforation 2241. In such way, the corresponding membrane switch 221 is electrically conducted, and the keyboard device 2 generates a corresponding key signal.

When the keycap 201 of the key structure 20 is no longer depressed, the keycap 201 is moved upwardly relative to the membrane circuit board 22 in response to an elastic force of the elastic element 203. Meanwhile, the first frame 2021 and the second frame 2022 are switched from the stacked state to the open-scissors state again, and the keycap 201 is returned to its original position.

Figure 10:
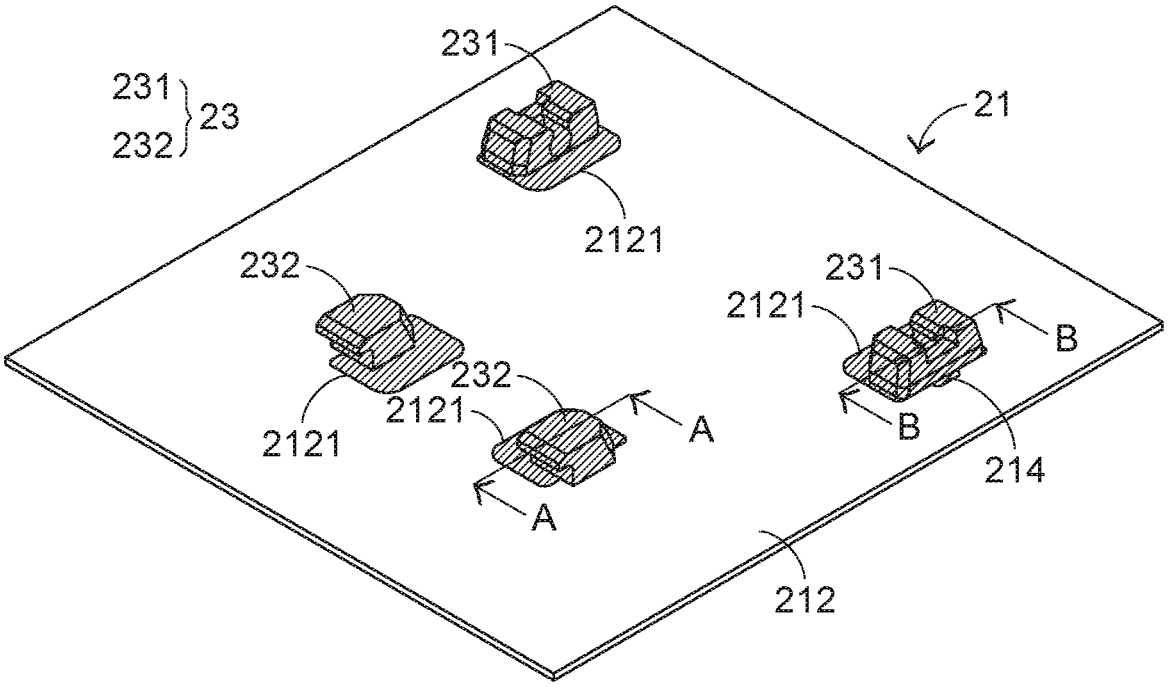
FIG. 10 is a schematic perspective view illustrating the combination between the coupling structures and the base plate of the keyboard device as shown in FIG. 5.

In accordance with a feature of the present invention, the plural coupling structures 23 to be connected with the connecting element 202 of the key structure 20 are formed on the base plate 21. The protrusion structures 211 of the base plate 21 are covered by the corresponding coupling structures 23. FIG. 10 is a schematic perspective view illustrating the combination between the coupling structures and the base plate of the keyboard device as shown in FIG. 5. Please refer to FIGS. 6 and 10. As mentioned above, the plural protrusion structures 211 of the base plate 21 are bent and protruded upwardly from the substrate 212. Consequently, there is a bent region 213 between each protrusion structure 211 and the substrate 212. Moreover, a coupling opening 214 is formed in the corresponding bent region 213. The substrate 212 further comprises plural through-holes 2121. The plural through-holes 2121 are in communication with the corresponding coupling openings 214. Moreover, the plural coupling structures 23 are formed on the base plate 21 by a plastic injection molding process.

Figure 11:
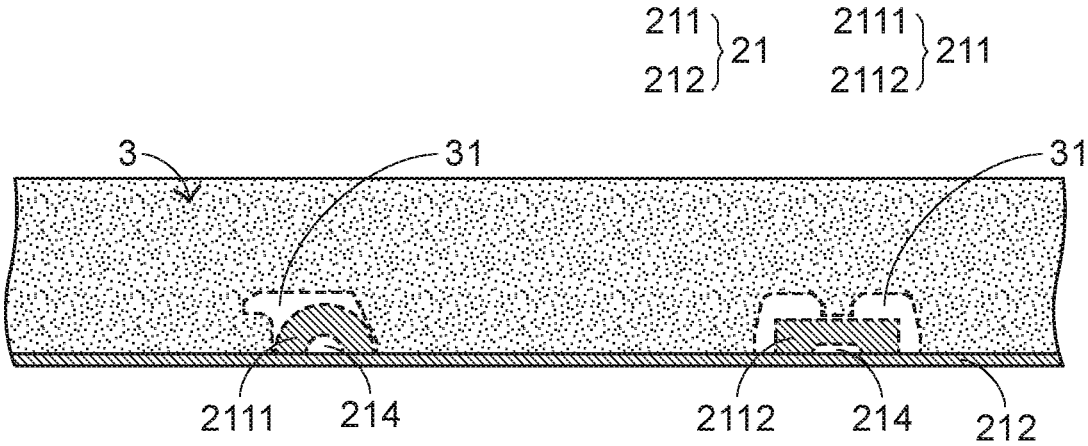
FIG. 11 schematically illustrates the concept of using a mold to form the coupling structures on the base plate as shown in FIG. 10.

FIG. 11 schematically illustrates the concept of using a mold to form the coupling structures on the base plate as shown in FIG. 10. For succinctness, the mold and the base plate shown in FIG. 11 are indicated by different textured patterns.

A process of forming the coupling structures 23 will be described as follows. Firstly, the base plate 21 and a mold 3 with plural formation chambers 31 are combined together. The shapes of the formation chambers 31 match the shapes of the coupling structures 23 to be formed. Then, a plastic material (not shown) is heated to be in a molten state and injected into the formation chambers 31 of the mold 3 through the through-holes 2121 of the substrate 212 and/or the coupling openings 214 in the bent regions 213. After the plastic material injected into the formation chambers 31 is cooled down and solidified, the coupling structures 23 are formed on the base plate 21. The technologies about the plastic injection molding process are well known to those skilled in the art. Consequently, the technologies about the plastic injection molding process will not be redundantly described herein. It is noted that the method of forming the coupling structures 23 is not restricted.

Figure 12:
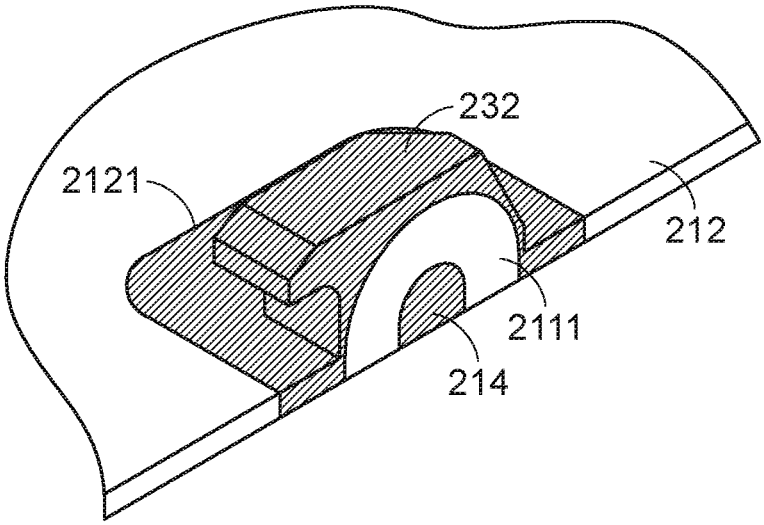
FIG. 12 is a schematic cutaway view illustrating the combination between the coupling structure and the base plate of the keyboard device as shown in FIG. 10 and taken along the line AA.
Figure 13:
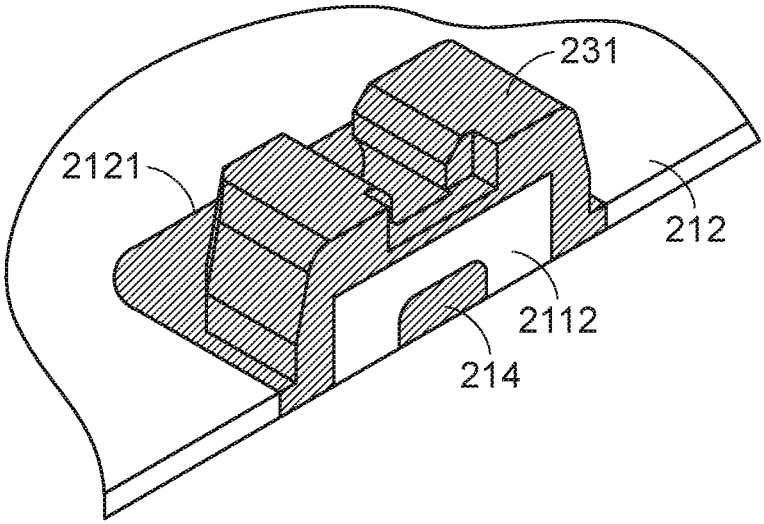
FIG. 13 is a schematic cutaway view illustrating the combination between the coupling structure and the base plate of the keyboard device as shown in FIG. 10 and taken along the line BB.

Please refer to FIGS. 10, 12 and 13. FIG. 12 is a schematic cutaway view illustrating the combination between the coupling structure and the base plate of the keyboard device as shown in FIG. 10 and taken along the line AA. FIG. 13 is a schematic cutaway view illustrating the combination between the coupling structure and the base plate of the keyboard device as shown in FIG. 10 and taken along the line BB. In this embodiment, the protrusion structure 211 that is disposed on the base plate 21 and covered by the corresponding movable coupling structure 232 has a semicircular flat plate body 2111, and the protrusion structure 211 that is disposed on the base plate 21 and covered by the corresponding fixed coupling structure 231 has an inverted L-shaped body 2112. During the above process of forming the coupling structure 23, the coupling opening 214 formed in the bent region 213 between the flat plate body 2111 of the protrusion structure 211 and the substrate 212 is filled with the movable coupling structure 232. Consequently, the movable coupling structure 232 has the pull-resistant property, and the movable coupling structure 232 is not readily detached from the base plate 21. Similarly, during the above process of forming the coupling structure 23, the coupling opening 214 formed in the bent region 213 between the inverted L-shaped body 2112 of the protrusion structure 211 and the substrate 212 is filled with the fixed coupling structure 231. Consequently, the fixed coupling structure 231 has the pull-resistant property, and the fixed coupling structure 231 is not readily detached from the base plate 21.

Figure 14:
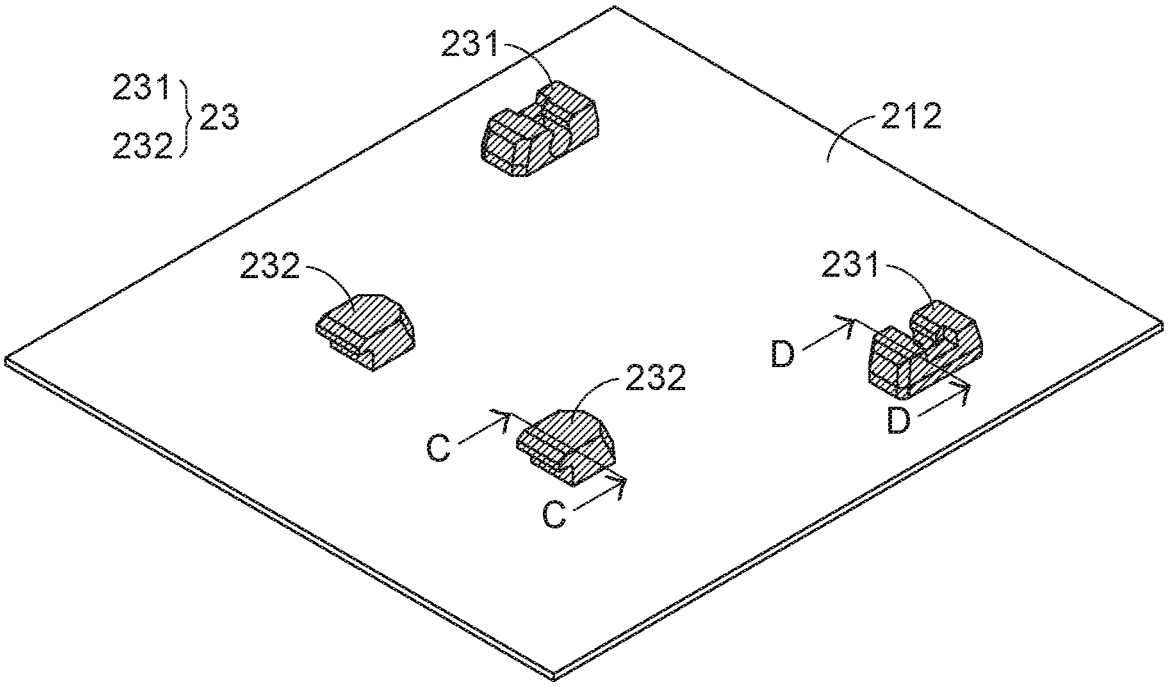
FIG. 14 is a schematic perspective view illustrating the combination between the coupling structures and the base plate of a keyboard device according to a second embodiment of the present invention.
Figure 15:
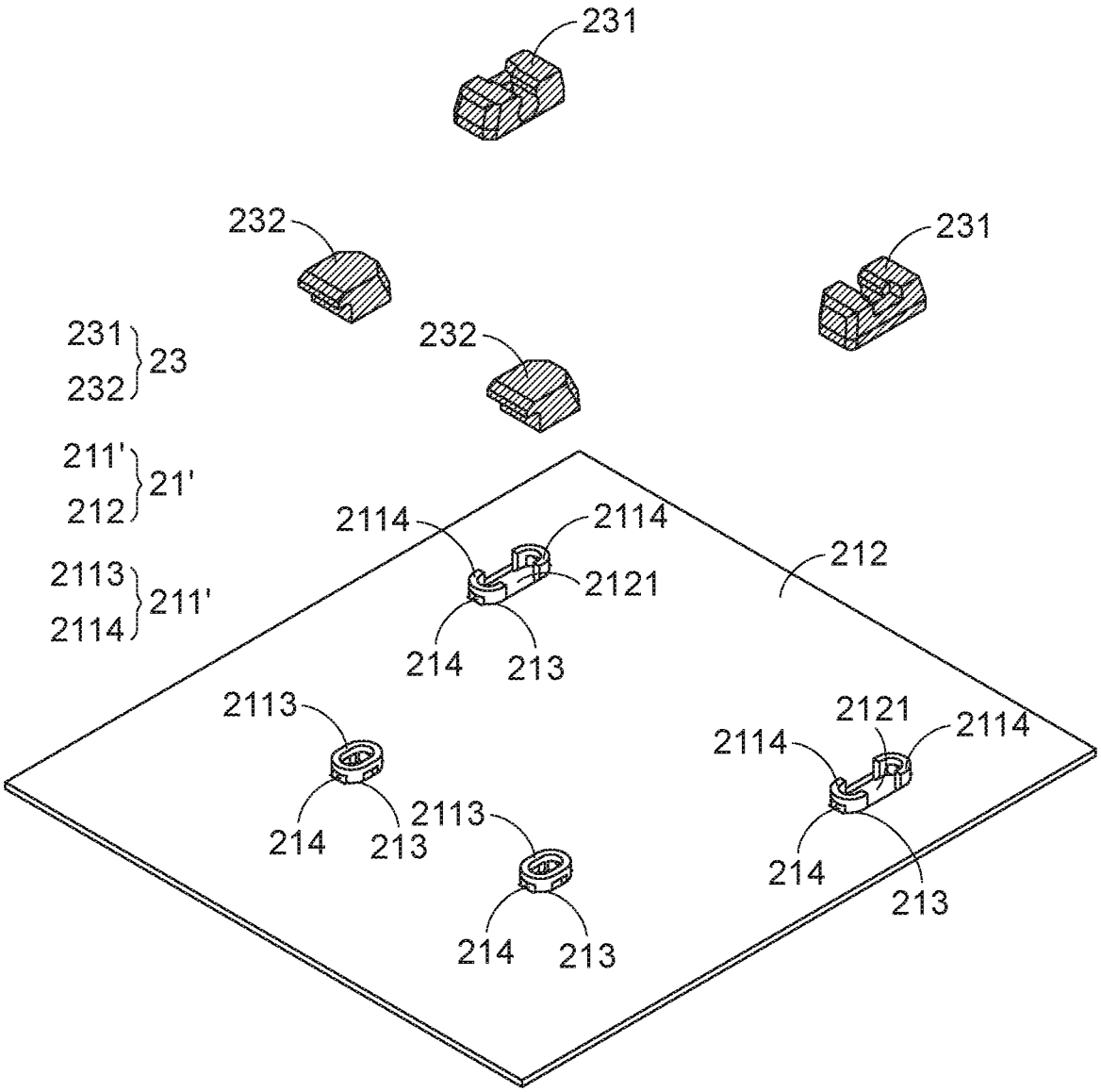
FIG. 15 is a schematic exploded view illustrating the coupling structures and the base plate as shown in FIG. 14.
Figure 16:
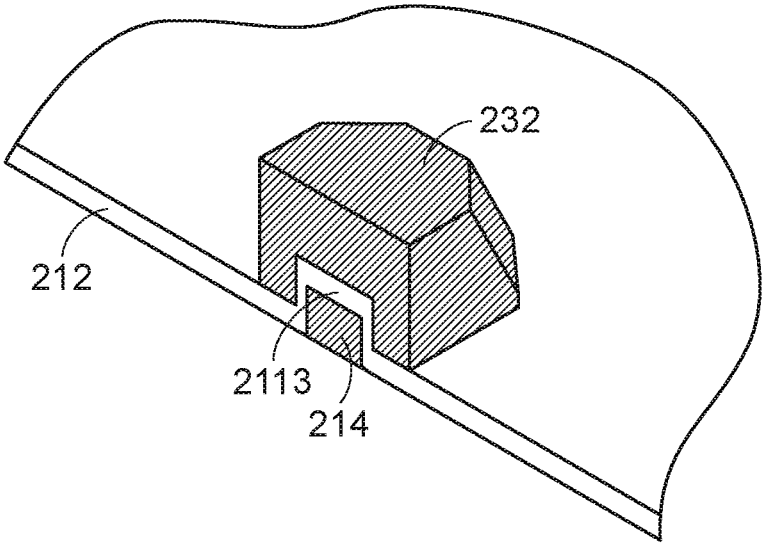
FIG. 16 is a schematic cutaway view illustrating the combination between the coupling structure and the base plate of the keyboard device as shown in FIG. 14 and taken along the line CC.
Figure 17:
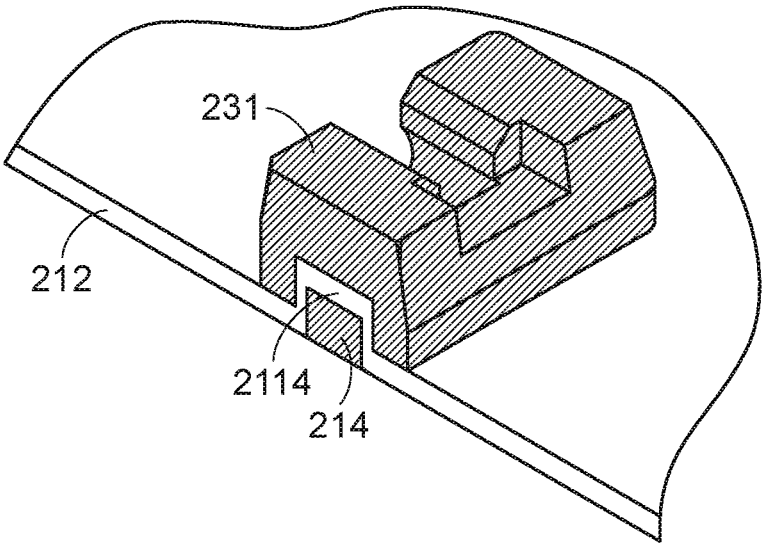
FIG. 17 is a schematic cutaway view illustrating the combination between the coupling structure and the base plate of the keyboard device as shown in FIG. 14 and taken along the line DD.

Please refer to FIGS. 14, 15, 16 and 17. FIG. 14 is a schematic perspective view illustrating the combination between the coupling structures and the base plate of a keyboard device according to a second embodiment of the present invention. FIG. 15 is a schematic exploded view illustrating the coupling structures and the base plate as shown in FIG. 14. FIG. 16 is a schematic cutaway view illustrating the combination between the coupling structure and the base plate of the keyboard device as shown in FIG. 14 and taken along the line CC. FIG. 17 is a schematic cutaway view illustrating the combination between the coupling structure and the base plate of the keyboard device as shown in FIG. 14 and taken along the line DD. The structures and actions of the components of the keyboard device which are identical to those of the first embodiment are not redundantly described herein.

In comparison with the first embodiment, the profiles of the protrusion structures of this embodiment are distinguished. In this embodiment, the protrusion structure 211' that is disposed on the base plate 21' and covered by the corresponding movable coupling structure 232 has an elliptical rod body 2113, and the protrusion structure 211' that is disposed on the base plate 21 and covered by the corresponding fixed coupling structure 231 has an arc-shaped curvy plate body 2114. The rod body 2113 and the curvy plate body 2114 are formed by a hole drawing process. The technologies of the hole drawing process are well known to those skilled in the art. Consequently, the hole drawing process will not be redundantly described herein. It is noted that the methods of forming the rod body 2113 and the curvy plate body 2114 are not restricted.

Similarly, during the above process of forming the coupling structure 23, the coupling opening 214 formed in the bent region 213 between the rod body 2113 of the protrusion structure 211' and the substrate 212 is filled with the movable coupling structure 232. Consequently, the movable coupling structure 232 has the pull-resistant property, and the movable coupling structure 232 is not readily detached from the base plate 21. Similarly, during the above process of forming the coupling structure 23, the coupling opening 214 formed in the bent region 213 between the curvy plate body 2114 of the protrusion structure 211' and the substrate 212 is filled with the fixed coupling structure 231. Consequently, the fixed coupling structure 231 has the pull-resistant property, and the fixed coupling structure 231 is not readily detached from the base plate 21'.

From the above descriptions, the present invention provides the keyboard device. The coupling structures to be connected with the connecting element of the key structure are additionally formed on the base plate. The base plate is not directly connected with the connecting element. In comparison with the conventional keyboard device, the thickness of the substrate in the base plate of the present keyboard device is reduced. Consequently, the technologies of the present invention are helpful for the miniaturization of the keyboard device, and the overall weight of the keyboard device is reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising: a membrane circuit board comprising a membrane switch; a base plate comprising a substrate and a protrusion structure, the substrate comprising a through-hole, wherein the substrate is located under the membrane circuit board, and the protrusion structure is bent and protruded upwardly from the substrate, wherein a bent region is formed between the protrusion structure and the substrate, and a coupling opening is formed in the bent region, wherein the through-hole is in communication with the coupling opening;

a coupling structure, wherein the coupling opening and the through-hole are filled with and covered by the coupling structure; and a key structure comprising a keycap and a connecting element, wherein the keycap is located over the membrane switch and connected between the keycap and the coupling structure, and the keycap is movable upwardly or downwardly relative to the membrane circuit board through the connecting element.

2. The keyboard device according to claim 1, wherein the coupling structure is formed on the base plate by a plastic injection molding process.

3. The keyboard device according to claim 2, wherein during a plastic injection molding process, the base plate and a mold are combined together, then a plastic material is injected into a formation chamber of the mold through at least one of the through-hole and the coupling opening, and finally the plastic material is cooled down, so that the coupling structure is formed on the base plate.

4. The keyboard device according to claim 1, wherein the protrusion structure has a flat plate body, a curvy plate body, an inverted L-shaped body or a rod body.

5. The keyboard device according to claim 1, wherein the base plate is made of a metallic material.

6. The keyboard device according to claim 1, wherein the connecting element comprises a first frame and a second frame, wherein the second frame is connected with the first frame and swung relative to the first frame.

7. The keyboard device according to claim 6, wherein the coupling structure includes a fixed coupling structure or a movable coupling structure, wherein a first end of the first frame is connected with the keycap, and a second end of the first frame is connected with the movable coupling structure, so that the second end of the first frame is slidable within the movable coupling structure, wherein a first end of the second frame is connected with the fixed coupling structures, and a second end of the second frame is connected with the keycap.

8. The keyboard device according to claim 1, wherein the keyboard device further comprises an elastic element between the keycap and the membrane circuit board, and the elastic element comprises a contacting part, wherein while the keycap is depressed, the elastic element is compressed and the membrane switch is triggered by the contacting part, wherein when the keycap is not depressed, the keycap is returned to an original position in response to an elastic force of the elastic element.

9. The keyboard device according to claim 1, wherein the membrane circuit board further comprises an upper film layer and a lower film layer, wherein a first circuit pattern is formed on the upper film layer, a second circuit pattern is formed on the lower film layer, the first circuit pattern comprises an upper contact, and the second circuit pattern comprises a lower contact, wherein the upper contact and the lower contact are separated from each other by a spacing distance and collectively defined as the membrane switch.

10. The keyboard device according to claim 9, wherein the membrane circuit board further comprises an intermediate film layer between the upper film layer and the lower film layer, so that the upper contact and the lower contact are separated from each other by the spacing distance, wherein the intermediate film layer comprises a perforation corresponding to the upper contact and the lower contact.

* * * * *